US008801591B1

(12) United States Patent
Lasorso, Jr.

(10) Patent No.: US 8,801,591 B1
(45) Date of Patent: Aug. 12, 2014

(54) PHYSICAL THERAPY WHOLE SOUND FREQUENCIES DEVICE AND METHOD OF USING THE SAME

(76) Inventor: Vincent J. Lasorso, Jr., Cincinnati, OH (US)

( * ) Notice: Subject to any disclaimer, the term of this patent is extended or adjusted under 35 U.S.C. 154(b) by 968 days.

(21) Appl. No.: 12/324,990

(22) Filed: Nov. 28, 2008

Related U.S. Application Data

(60) Provisional application No. 60/990,802, filed on Nov. 28, 2007.

(51) Int. Cl.
*A61H 23/00* (2006.01)

(52) U.S. Cl.
USPC ..... 600/28

(58) Field of Classification Search
USPC ..... 600/28, 26, 27; 128/897, 898
See application file for complete search history.

(56) References Cited

U.S. PATENT DOCUMENTS

| | | | | |
|---|---|---|---|---|
| 3,556,088 | A | 1/1971 | Leonardini | |
| 3,880,152 | A | 4/1975 | Nohmura | |
| 4,064,376 | A | 12/1977 | Yamada | |
| 4,216,766 | A | 8/1980 | Duykers et al. | |
| 6,027,463 | A * | 2/2000 | Moriyasu | 601/46 |
| 6,702,767 | B1 * | 3/2004 | Douglas et al. | 601/15 |
| 7,232,417 | B2 | 6/2007 | Plante | |
| 7,402,922 | B2 | 7/2008 | Springer et al. | |
| 2005/0226449 | A1 * | 10/2005 | Young | 381/333 |

* cited by examiner

*Primary Examiner* — Christine Matthews
*Assistant Examiner* — Joshua D Lannu
(74) *Attorney, Agent, or Firm* — The Law Office of Patrick F. O'Reilly III, LLC

(57) ABSTRACT

The present invention includes a device and method for relaxing and promoting healing to an individual by synchronization of kinesthetic and aural whole tone sounds.

17 Claims, 4 Drawing Sheets

PHYSICAL THERAPY WHOLE SOUND FREQUENCIES DEVICE AND METHOD OF USING THE SAME

CROSS-REFERENCE TO RELATED APPLICATION

The present application claims priority to U.S. Provisional Patent Application No. 60/990,802 as filed Nov. 28, 2007.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to improved individual health and well being based upon vibrational energies, and more particularly relates to physical and auditory stimulation of biological tissue through whole sound frequencies and harmonics.

2. Description of the Related Art

When a cell of any living organism is confronted with a source of stress, the cell constricts itself to avoid impact. Such response has been referred to as "bracing."

Substantially, all cells within the human body react the same when they are confronted with a stressor. Whether that stressor is mechanical activity, chemical, electrical, viral, or bacterial, the cell typically reduces its respective size to limit exposure to injury. When the stressor is removed, the cell returns to its normal pre-stress size. If the stressor is not removed, the cell will typically maintain its reduced size until the cell exhausts its internal resources and fails.

The average human body is confronted with numerous stressors, including, for example, sound, vibrations, temperature, pollution, and electromagnetic radiation. Skin and the musculoskeletal system typically absorb such stressors to defend inner workings of the body. However, the same inner workings are also assaulted by ingested and absorbed toxins, which also result in bracing through many systems of the body.

A human mind is also a generator of stressors. The mind interprets interpersonal and social activities and interactions as "threats" to its emotional well-being. Such cognitive threats create hormonal "fight or flight" reactions causing cellular bracing substantially throughout the body.

Cells of the body are connected by a web of connective tissue called the extracellular matrix (ECM). The ECM provides a space between cells called the interstitial space, where the exchange of nutrients and waste occurs. The ECM is patrolled by large leukocytes exterminating invading viruses, bacteria, and damaged or cancerous cells. As cells brace, they become more rigid and impenetrable to invaders as well as chemicals and nutrients necessary for cell health. Bracing cells pull upon the connective tissues of the ECM, thereby narrowing space between cells. Such diminished space, first prevents the leukocytes from patrolling the space, then diminishes the exchange of waste and nutrients and finally, when the space becomes too narrow, creates an inflammatory process resulting in death of existing cells and malformation of regenerated cells.

The most common experience of bracing is myofascial tension and pain causing secondary arthritis and joint destruction. The average body responds to the external stressors of its environment and the inner stressors of the mind, by tensing muscle fibers. If cells are consistently exposed to similar stressors, the cells will adapt by maintaining the braced state, even when the stressor is absent. Such chronic adaptation is called "habitual bracing." Habitual bracing defines the new baseline of muscle length within the stretch receptors of the muscle spindles and the proprioception model of the brain. The body "believes" that any less tension leaves it vulnerable. Since the base line within the brain and stretch receptors has been modified, the body no longer notices the "tension" among the cells, thereby shortening and misaligning associated muscles. The habitual bracing of any muscle group within the muscle skeletal system begins a slow degenerative process of the entire organism.

A muscle group that shortens, due to a stressor, may put adjacent muscles and joints into a state of tension, and becomes a secondary stressor to those fibers. Over time, the adjacent muscles and joints may to adapt into habitual bracing.

Both movement and stabilization of the body is generated by a harmonizing polarity between agonist and antagonistic muscle groups; one in action, and the other in repose. The habitual bracing and shortening of a group of muscles may also stress its complimentary antagonist. Eventually the baseline and proprioceptive model of the entire body is changed, and may adversely affect joint alignment, range of motion, and balance. It should be noted that as new stressors are added, the muscles respond once again by bracing from their now shortened baseline. And as before, consistent exposure can create a new habitual baseline. At some point, the muscles braces to a length which stimulates neural pain receptors in the muscle. When a nerve is continually over stimulated, the nerve will habitually create a chronic pain response.

Aside from movement of the associated body, muscles are the primary means of propelling blood through veins and fluids through the aforementioned interstitial spaces. Blood moves from the capillary beds and into the veins by pressurized displacement from newly arrived arterial blood. Once in the veins, muscular action and one-way valves move the blood until it reaches larger muscular veins. Inadequate muscular action can begin the process of peripheral artery disease and blood clots.

The motility of the interstitial fluid is the means in which waste is transported into the lymphatic system and ultimately out of the body. Substantially all cellular metabolism and immune response is dependent upon the interstitial flow. Muscles in habitual bracing are often no longer able to adequately expand and contract in a full enough range to efficiently squeeze the interstitial fluids entirely out of the lymph capillaries leaving the body very vulnerable to disease.

As the external muscles change shape and position they also change the internal space and pressures affecting the function of vital organs including the brain.

Bracing along the spine, back, and chest may inhibit respiration, intestinal motility, organ flow, and output. However, bracing has it most profound effects upon the brain.

Bracing of the head and spinal column influences brain functioning in three important ways.

First, the muscles around the skull can inhibit the exchange of cerebral spinal fluid (CSF) into the veins of the sub-arachnoid granulations, i.e., the blood/brain gateway/barrier, by increasing venous pressure. Thus, the dissemination of hormones into the blood stream of the body is diminished.

Second, the muscles around the base of the skull and the neck can displace and torque the cervical vertebra applying tension in the meninges, thereby increasing intra-cranial pressure upon the brain, diminishing cognitive functioning, and inhibiting CSF exchange across the blood/brain barrier, and circulation of CSF through the brain's ventricles.

Third, bracing of the spine from lumbar to the skull reduces the flexion pumping action of CSF from the lumbar reservoir into the ventricles of the inner brain called the cerebral-spinal pump (CSP). The CSF circulates within the spaces of the brain disseminating nutrients, hormones, neurotransmitters and eliminating waste. The CSF cleans, nourishes and protects the brain and spinal cord. Clean circulating fluid is essential to insure proper transmission of neurotransmitters across the neuro-synaptic gaps. Waste products prevent transfer and reuptake of neurotransmitters, resulting in cognitive and emotional dysfunction. The cleanliness of the CSF is so important that the body produces three times its volume each day, with old fluid draining into the lymphatic system.

The circulation of CSF by the CSP performs two other functions. In particular, the circulation stimulates the lower brain stem and cerebellum and disseminates non-differeniated stem cells. Non-differentiated stem cells repair damaged regions of the brain and differentiate to create new brain where neural demand is large.

Stressors change the physical environment of the cells. The bracing reaction is in turn a physical reaction to an unhealthy environment. There is no chemical or intercellular mechanism to relax a braced cell. The cells will only relax via mechanical action upon the integrins. The integrins attach to the ECM and pass through the cellular membrane into the nucleus and the DNA itself. Physical, pulsating messages of an expanding relaxing ECM convince the nucleus to let go of its protective tension. For this reason the best way to release physical stress is through movement, stretching and physical manipulations, e.g. massage, rolfing, and the like.

With a simple glance at an anatomy chart one quickly observes that muscle groups and fibers freely pass under, over, and even through each other. Given that stressors do not uniformly affect all muscle fibers equally within a muscle, and that all muscle fibers within a muscle do not receive an equal amount of movement, a pathological conditions occurs which we call "binding." Binding occurs when braced; shortened fibers of a muscle impede another fiber from moving along its normal vector or through its complete contraction/relaxation range. The binding itself becomes a source of stress and low grade inflammation, progressing to a state of actually stopping the movement of some fibers of the muscle. Pathology, historically known as "muscle bound," occurs when a region of the muscle becomes effectively immobile and sometimes literally bounded by other fibers within it. These regions are also known as "knots" and "trigger points." Bounded sections of muscles are "splinted" from the actions of movement, exercise, and stretching which would normally release the bracing. The bound sections rarely respond completely to classical "rubbing" or mechanical vibrating massage because the reset stretch receptors only release to the shortened length. The fibers have to be manually released and repositioned by deep tissue therapies, which may include the use of Botox or surgery.

One means for releasing such binding and bracing is through the use of sound. Physical and psychological therapy using sounds is not a new concept. Pythagoras, the Greek mathematician and philosopher, codified tones, intervals, and modes of sound that tended to best heal, unify, and create a balanced mind and body. This work by Pythagoras has become a foundation of western music, science, holistic homeopathic medicine, and religion.

Disciples of Pythagoras mastered a mind and body connection through chanting and lyre playing. In doing so, diseases healed, bodies were conditioned, and minds and bodies were elevated. The ongoing work of Pythagoras' work unlocked secret mathematical proportions and energies of the universe, and therein resulted formulae for health, longevity, physical transformation, and spiritual ascension.

In the current era, vibrational noise has been used to heal individuals, both of mind and body. However, typical such vibrational noise therapy is of a single vibrating frequency.

Vibroacoustic therapy is a known method of playing music or other tones through an object to vibrate an individual's body to relieve pain and/or anxiety, and to induce healing.

What is needed is a device and method for relaxing and promoting healing of an individual through a mixture of vibrational energy and sound.

SUMMARY

The various exemplary embodiments of the present invention include a device for relaxing and promoting healing of biological tissue. The device is comprised of an inputting means for generating a digital signal based upon one or more acoustic sounds introduced to the inputting means, and one or more vibrational units connected to the inputting means. The one or more vibrational units have a user interface, a processing means for generating frequency pulse waves based upon the digital signal relayed by the connected inputting means, and a vibrating means producing vibrational transfer of energy synchronized to the frequency pulse waves of the processing means. The device further includes at least one auditory relay unit connected to the inputting means. The at least one auditory relay unit having speakers for transferring an auditory signal associated with the digital signal of the inputting means. An individual is placed in substantial contact with the one or more vibrational units and the at least one auditory relay unit for a predetermined period of time.

The various exemplary embodiments further include a method for relaxing and promoting healing of biological tissue. The method is comprised of the steps of positioning a device substantially adjacent to an individual's body, positioning at least one auditory relay unit near or on the individual, and orchestrating substantially synchronized vibrations and auditory signals for a predetermined period of time. The device is comprised of an inputting means for generating a digital signal based upon one or more acoustic sounds introduced to the inputting means, and one or more vibrational units connected to the inputting means. The one or more vibrational units have a user interface, a processing means for generating frequency pulse waves based upon the digital signal relayed by the connected inputting means, and a vibrating means producing vibrational transfer of energy synchronized to the frequency pulse waves of the processing means. The device further includes at least one auditory relay unit connected to the inputting means. The at least one auditory relay unit having speakers for transferring an auditory signal associated with the digital signal of the inputting means. An individual is placed in substantial contact with the one or more vibrational units and the at least one auditory relay unit for a predetermined period of time.

The exemplary embodiments further include a system for relaxing and promoting healing of biological tissue. The system is comprised of one or more computers for analyzing and/or monitoring physiological status of an individual, and a device connected to the one or more computers. The device is comprised of an inputting means for generating a digital signal based upon one or more acoustic sounds introduced to the inputting means, and one or more vibrational units connected to the inputting means. The one or more vibrational units have a user interface, a processing means for generating frequency pulse waves based upon the digital signal relayed by the connected inputting means, and a vibrating means producing vibrational transfer of energy synchronized to the frequency pulse waves of the processing means. The device further includes at least one auditory relay unit connected to the inputting means. The at least one auditory relay unit having speakers for transferring an auditory signal associated with the digital signal of the inputting means. An individual is placed in substantial contact with the one or more vibrational units and the at least one auditory relay unit for a predetermined period of time.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
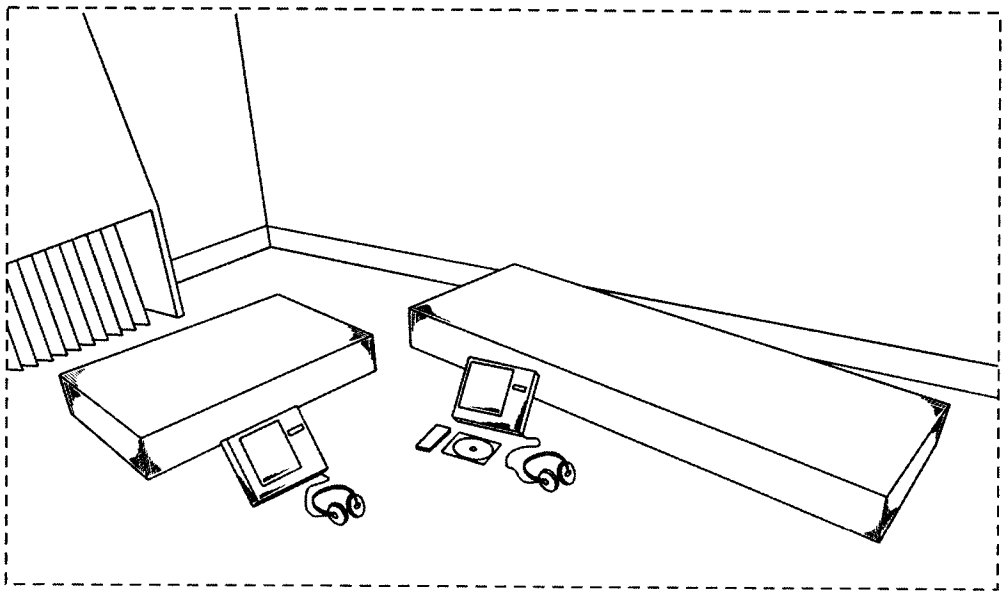
FIG. 1 is an illustration of a vibrational unit of an exemplary embodiment of the present invention.

The various exemplary embodiments of the present invention include a device, system, and method for relaxing and promoting healing of biological tissue of an individual. The various exemplary embodiments include an inputting means for introduction of predetermined acoustic sound.

A true "sound" as used herein is comprised of proportional frequencies working in harmony to create a single perceivable tone. Such proportional frequencies are substantially identical to the proportional frequencies of bodies, cells, and molecules of individuals.

Typical vibrational noise replicators, that is, for example, massagers, vibrators, and the like, produce perceived positive results on the body by actually attacking the body. These vibrational noise replicators are usually mechanical in nature and induce regular pulsing waves into the individual's body which violently stresses cells of the individual. Such violent stressing of the cells forces the cells into a bracing protective mode.

In the first several minutes of such stressing upon the cells, a body's adaptive responses produce deep level tension that can lead to positive strengthening. However, after a short period of time, typically about ten minutes, the adaptive responses start to fail in resisting the regular pulsing waves and the adaptive responses "let go" of body tension out of sheer exhaustion. After about twenty more minutes of such regular pulsing waves, a cellular destructive cycle initiates.

Various exemplary embodiments of the present invention include a sound delivery system. The preferred system transfers substantially full harmonic, acoustically generated, structured sound (whole sounds) vibration into an individual's body to orchestrate systemic functions of the tissues, fluids, and nervous system in order to release and reverse the negative effects of bracing. Whole sounds are specifically engineered by frequency and modulation to preferably achieve a targeted predictable effect upon tissues and structures.

It is preferred that the whole sounds are simultaneously delivered to the body though various senses: aurally into the central nervous system of the brain; conductively through the bones; acoustically through the bodily fluids and spaces; and piezoelectrically through bands of connective tissue and peripheral mechanoreceptors (sensory nerves). The simultaneous stimulation of a combination or substantially all of these bodily systems with the whole sounds, accesses and releases bracing in many or all manner of tissue. Such accessing and releasing resets the original proprioceptive values on muscle length and position re-ordering the body to its "normal" functioning and range of motion.

The various exemplary embodiments may use uses a Primary Sound Delivery Unit (PSDU), which, through substantially direct contact with a body, preferably transfers whole sound vibrations into bones, tissues, and peripheral nerves of the body. The PSDU has four preferred configurations: a platform upon which an individual may sit, lay, and/or exercise upon; a notebook-sized box plate; a contoured wedge-shape device to be placed under an individual's feet, under an individual's legs, or upon an individual's back; and a neck device to be worn over an individual's shoulders and in contact with the back of the individual's neck.

The PSDU includes transducers to vibrate the unit using whole sounds. The PSDU is attached to a substantially solid surface that preferably will directly contact the individual's body. The sound moves into the tissues activating the mechanoreceptors of the nervous system and integrins of the cells. The vibration then moves into the bones and is conducted throughout the entire skeletal system. It is through the bones that all the tissues of the body are accessed.

Striated muscle connects to bones via tendons. The sound of the present exemplary embodiments is transferred through the tendons directly to spindles of the striated muscles of the individual's body. Such transfer allows the signal to bypass any resistance from bracing or muscle binding that would prevent release from occurring through massage or exercise.

A shortened muscle will naturally be in tension across its body to the points at which the muscle attaches to the skeletal frame. This normally pathological state becomes therapeutic with the introduction of whole sound. The tension provides a traction vector elongating the muscle to its normal length while the sound, through an orchestrated combination of frequency and modulation, acts upon the mechanoreceptors of the muscle spindle, to release the tension of the muscle. The muscle spindle, with its reset pathological bracing proprioceptive length value, under normal circumstances would react with pain at an attempt to restore it to its non-pathological condition.

Pain is gated from being experienced through the simultaneous actions of: over-stimulation of sensory pain mechanoreceptors in the skin and connective tissue; over-stimulation of pain receptors within the skeletal structure; aural stimulation of the brain with binaural beats creating a frequency following response that alters cognitive perception in a manner to not perceive pain; rhythmic patterned stimulation of the cerebellum by the simultaneous application of whole sound through the auditory cortex and physical vibration of the organ via acoustic fluid pulsations of the CSF in a manner to trigger the release of endorphins and dopamine.

The majority of bracing occurs while the human body is in a vertical orientation, that is, wherein a longitudinal axis of the human body is substantially perpendicular to the ground while standing or sitting. The vector on which the shortening occurs is the axis with the maximum amount traction on the spindles requiring release. Sound conductivity through the bone is at its maximum effectiveness, for responsiveness and transmission, along the longitudinal axis of the bone perpendicular to the PSDU.

For these stated reasons, re-establishing the pre-pathology length of striated muscle is greatly enhanced by the performance of stretching, range-of-motion exercises, Yoga, Pilates or Qigong while sitting or standing upon the platform versions of the invention. Movements in combination with traction increase the stimulation on the mechanoreceptors and speeds the process of muscle release. Torsional and rotational movement of an individual's limbs, clockwise and counter-counter clockwise around the longitudinal axis, unwinds the muscles in their natural lines of contraction, and are therefore, more effective than movements parallel to the bone axis.

An increase in strength is created almost immediately with the first application of whole sound, under all frequencies and modulations, and continues to increase through a three phase learning process: the frequencies release the muscle bracing to normal lengths allowing the muscle full use of all its fibers along its entire length; the vibration of the sound decreases resistance within and between fascias of adjacent muscles; and the consistent vibration causes all local cells to harmonize and entrain to each other through the localized communication system of the integrin and connective tissue network, training and recruiting local fibers and muscle groups to work as a cohesive, coherent, connective unit making more fibers available for any given task. The new localized community reorganizes the neural pathways of the sensory motor cortex to create new permanent patterns. Strength may also be created by utilizing frequencies and modulations below about 50 Hertz that cause low intensity, short duration stress to cells causing a natural, strengthening, bracing contraction immediately followed by a relaxation phase for recovery. This passive cellular exercise can be especially effective on those who are physically infirmed.

Bone density and strength is created through the same passive cellular exercise. Bone strength and density is also increased naturally in reaction to the increased stressors applied to the bone structures by the now stronger musculature. As muscle fibers are relaxed, resistance between articulating bone surfaces are reduced and the muscle stress is redirected to their natural tendon attachments along the bone's surface. The natural, more evenly distributed muscle stress activates more osteoblasts along the length of the bone, creating an even growth and density of new bone. With the relief of pressure on articulating bone surfaces, the cartilage, with or without, nutritional supplementation, has the opportunity to regenerate.

Various exemplary embodiments of the present invention include the potential for neural regeneration. Fine, discrete, nuanced motor control, i.e., skill, over the muscles of the body to perform detailed tasks of sport, art, music, etc. is achieved from thousands of repetitions of the movement patterns which in turn increase neural density within the regions of the sensory motor cortex of the brain that is responsible for generating the movements. Numerous repetitions of a task overload the sensory and motor neurons forcing each to recruit other neurons of the brain to take the load. This is analogous to a business hiring temporary workers during a busy season. As training continues over the course of days, the neurons of the motor cortex, like striated muscle cells, send out a signal for new brain cells to be permanently assigned. Unlike muscle cells, brain cells are born from non-differentiated stem cells floating in reserve in the CSF filled ventricles of the midbrain. The stem cells swim through the CSF to the region of the motor cortex requesting cells. The stem cells differentiate to become permanently dedicated motor cells. Current research suggests that the brain repairs and expands itself only in reaction to increased, sustained, concentrated, demand for many hours per day over the course of many days.

The invention, in all its configurations, stimulates brain repair and expansion of neurons by: simultaneously overloading the entire sensory motor cortex, neo cortex, auditory cortex, and cerebellum, limiting the amount of available neurons for recruitment to execute a training or rehabilitation pattern, accelerating the request for stem cells; inducing a physiological "relaxation response" creating a fertile, environment for cellular differentiation; guiding the brain to a theta dominant brain wave state, diminishing chaotic cognitive chatter to enhance neural focus upon the training pattern; and stimulating the circulation of CSF insuring a clean, unobstructed medium for efficient stem cell travel from ventricle to location of demand.

The device of the exemplary embodiments herein synergistically stimulates an individual through kinesthetic sound by way of a vibrational unit and through aural sound by way of an auditory relay unit.

Figure 4:
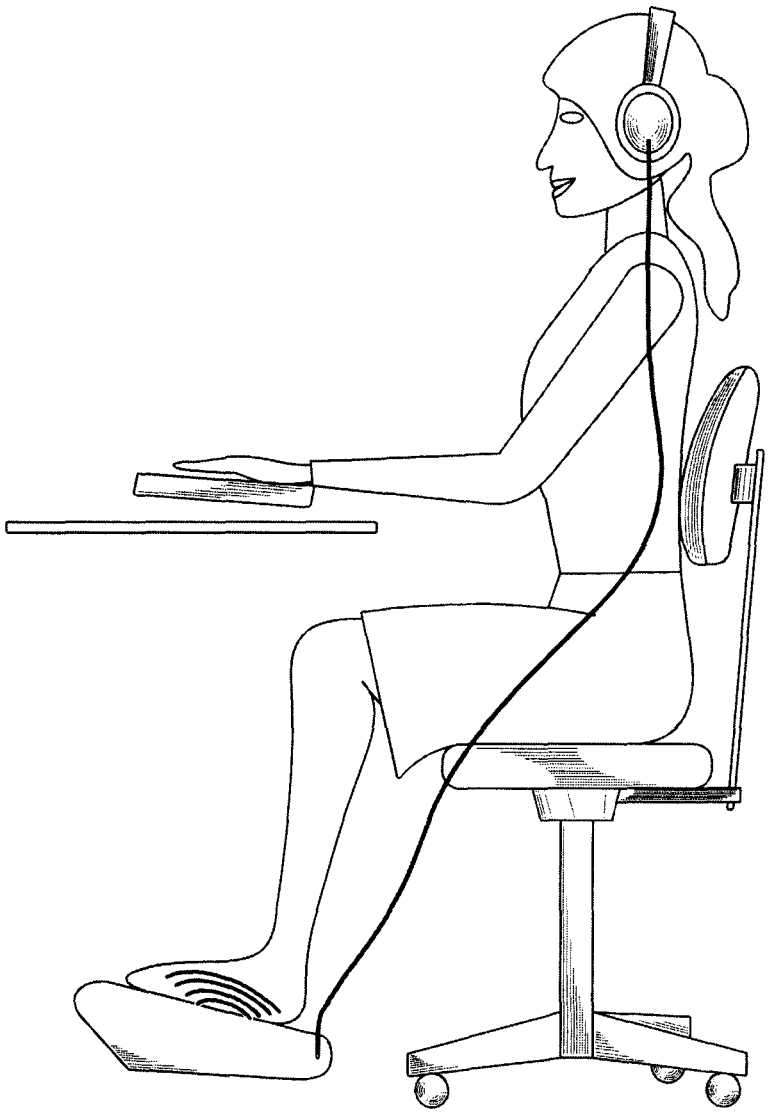
FIG. 4 is an illustration of an exemplary embodiment of the device of the present invention as utilized by an individual.

The auditory relay unit, as illustrated in FIG. 4, may be in the form of a personal digital music player. Other examples of inputting means may include compact disc (CD) players, digital video disc (DVD) players, mp3 format players, mp4 format players, personal computer system, or other similar unknown sound transmitter.

The auditory relay unit in the various exemplary embodiments preferably provides acoustical sounds which include sounds produced by one or more acoustical musical instruments, one or more human voices, one or more animal voices, or a combination thereof. Acoustical sounds are preferred because the sounds typically are not considered "droning" and include natural overtones.

Figure 2:
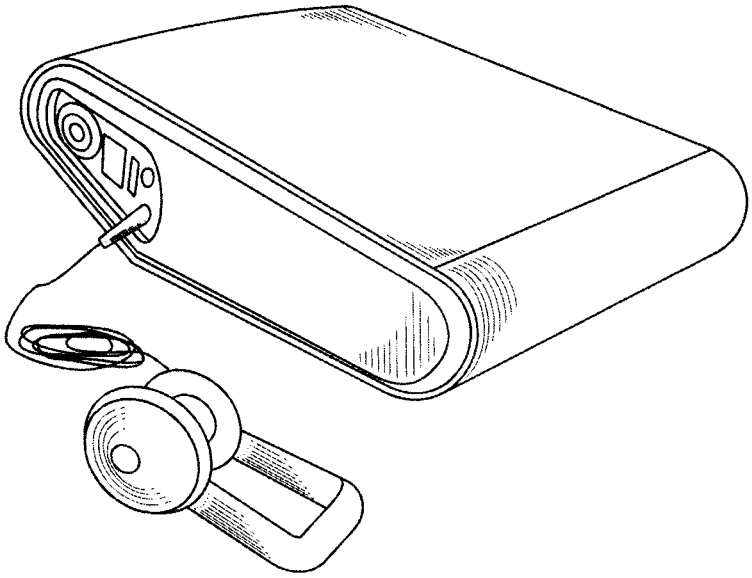
FIG. 2 is an illustration of another vibrational unit of an exemplary embodiment of the present invention.
Figure 3:
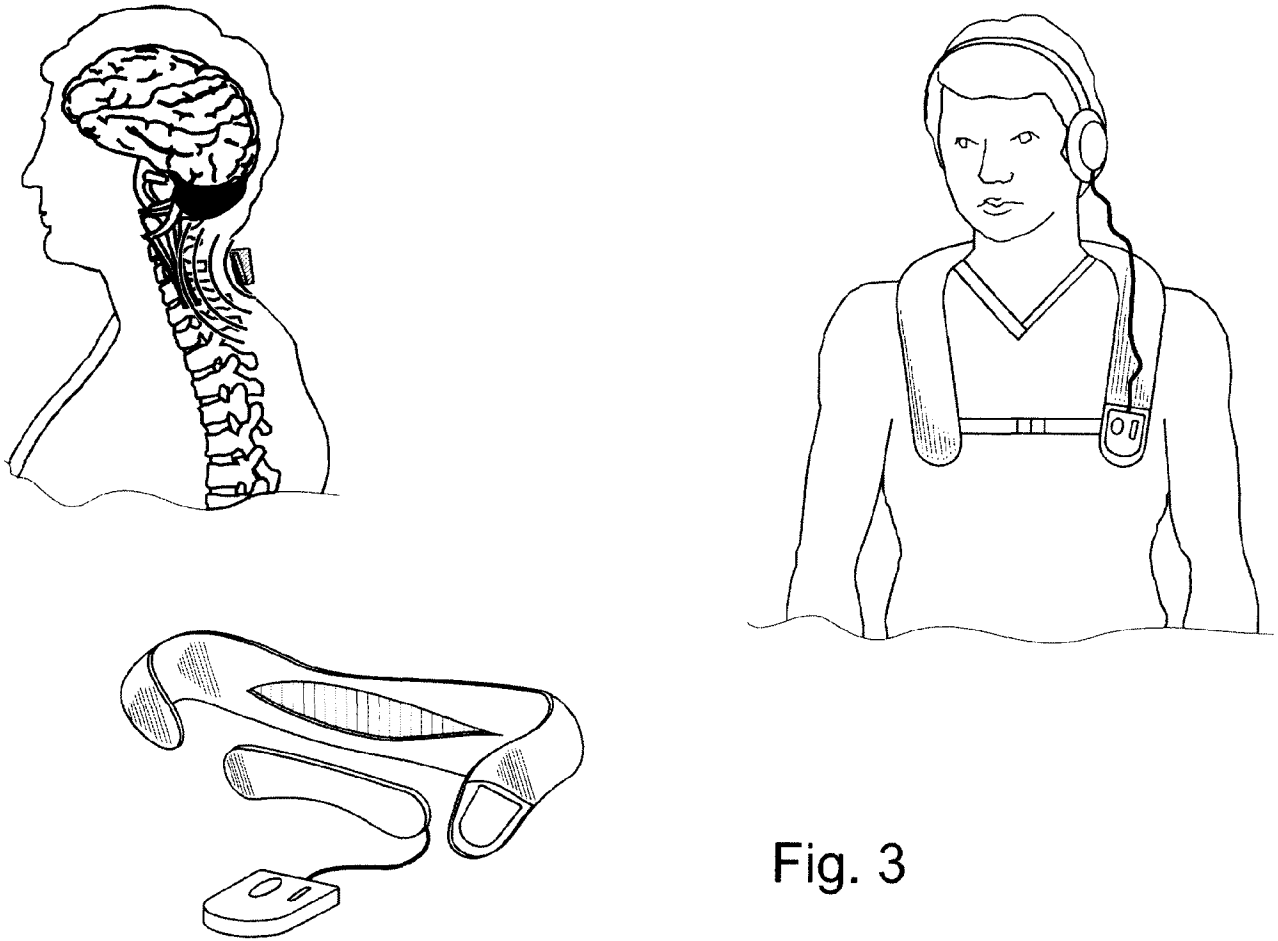
FIG. 3 is an illustration of yet another vibrational unit of an exemplary embodiment of the present invention.

In the various exemplary embodiments, the auditory relay unit is connected to one or more vibrational units. Exemplary vibrational units are illustrated in FIGS. 1-3.

Each vibrational unit preferably includes a user interface to manipulate the functioning of the respective vibrational unit. An exemplary user interface may include a power control, an amplitude control, and the like.

Each vibrational unit of the exemplary embodiments of the present invention also includes a processing means. The processing means generates frequency pulse waves based upon the digital signal relayed by the connected inputting means. Such processing means may be in the form of, for example, a microprocessor.

The processing means of the one or more vibrational units is connected to a vibrating means to produce vibrational energy that may be transferred to adjacent and/or substantially close individuals and/or objects. It is preferred that the vibrational energy produced be synchronized to the frequency pulse waves of the processing means.

Thus, as the inputting means plays predetermined acoustic sounds, the processing means of the one or more vibrational units generates frequency pulse waves which cause vibrational energy to be transferred away from the one or more vibrational units.

FIG. 1 illustrates an exemplary embodiment of a vibrational unit according to the present invention wherein the vibration unit is shaped as a rectangular box. In such exemplary embodiment, an individual may stand, sit, lay upon, etc. the vibrational unit such that the acoustic sound played by the inputting means is transferred to be output as vibrational energy through the vibrational unit and through the body of the individual adjacent to and/or substantially close to the vibrational unit.

The shape of the vibrational unit represented in FIG. 1 allows for an individual to be in contact with another object that is more fully in contact with the vibrational unit than the individual is. That is, for example, an individual may receive the vibrational energy from the vibrational unit through a chair or wheelchair.

Another exemplary embodiment of the one or more vibrational units is presented in FIG. 2 wherein the vibrational unit is shaped such that it has a somewhat triangular cross-sectional area.

The shape of the vibrational unit of FIG. 2 may be used by an individual on the bottom of the individual's feet, positioned as a lumbar support, placed under an individual's head, positioned adjacent to an individual's neck, etc. to allow for more localized concentration.

FIG. 4 illustrates an exemplary embodiment wherein the vibrational unit illustrated in FIG. 2 is placed on the bottom of an individual's feet.

FIG. 3 illustrates the exemplary embodiment wherein the vibrational unit is a scarf-like shape that can be placed around the neck and over the shoulders of an individual.

The illustrated vibrational units may be used in combination with one another or singly. Further, it should be understood that the vibrational units illustrated in the drawings are representative and do not include all possible variations of the vibrational units.

The device of the present invention further includes one or more auditory relay units for conveying the acoustic sounds of the inputting means. Thus, the auditory relay unit may be in the form of, for example, auditory speakers, headphones, or a combination thereof. It is preferred that the auditory relay unit be in the form of headphones that substantially cover both ears of an individual in order to substantially reduce the possible pollution of the predetermined acoustic sound from the inputting means.

As illustrated in FIG. 4, an individual positions herself in substantial physical contact with one or more vibrational units of the present device. In FIG. 4, the individual is contacting her feet against a vibrational unit connected to an inputting means. In addition, the individual has placed the auditory relay unit, in the form of headphones, over her ears.

Once in a comfortable position with both the vibrational unit and the auditory relay unit, the inputting means is powered to play predetermined acoustic sound. The acoustic sound from the inputting means is processed into vibrations emitted by the vibrational unit against the soles of the individual's feet such that the vibrations are synchronized to the acoustic sound of the inputting means. Simultaneously, the individual is listening to the acoustic sound through the headphones.

The synchronized sound and vibrational energy is able to synergistically promote positive cell activity in order to relieve pain, cause relaxation, reduce stress, relieve sinus and tension pain, tone tissues, promote muscle development, improve mood, promote sleep, improve circulation, and improve neural functions.

The vibrational energy and sound passes through the entire organism by way of an individual's skeleton, the extra-cellular matrix of connective fibrous tissue, and through auditory waves within the fluids of the circulatory system and/or central nervous system.

Together, the vibrational energy and the sound stimulate both hemispheres of an individual's brain; a hemispheric synchronization is achieved thereby bringing both body and mind into a harmony.

In various exemplary embodiments, the device may be connected to one or more computers for analyzing and/or monitoring physiological status of an individual.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A device for relaxing and promoting healing of biological tissue, the device consisting essentially of:

an inputting means configured to generate a digital signal based upon one or more predetermined acoustic whole sounds introduced to the inputting means, the one or more predetermined acoustic whole sounds consisting of proportional harmonic overtone frequencies, and the one or more predetermined acoustic whole sounds being configured to engage and direct tissues and cells of human beings through whole sound harmonic frequencies;

one or more vibrational units connected to the inputting means, each of the one or more vibrational units comprising a housing, the housing having a length, width, and a height, the length and the width of the housing being substantially greater than the height of the housing so that the housing is capable of being comfortably placed underneath, or around, a portion of a body of an individual, the housing further including a solid top surface, and the housing being in the shape of one of: (i) a generally rectangular box, (ii) a generally wedge-shaped box, or (iii) a generally U-shaped elongated member, and the one or more vibrational units having:

a user interface;

a processing means for generating frequency pulse waves based upon the digital signal relayed by the connected inputting means; and one or more transducers disposed inside the housing, the one or more transducers configured to vibrate the one or more vibrational units using the one or more predetermined acoustic whole sounds effective to transfer the one or more predetermined acoustic whole sounds into one or more of bones, tissues or peripheral nerves of an the individual; and at least one auditory relay unit connected to the inputting means, the at least one auditory relay unit having speakers for transferring an auditory signal associated with the digital signal of the inputting means;

wherein the housing of each of the one or more vibrational units and the at least one auditory relay unit are configured to be placed in contact with the individual for a predetermined period of time.

2. The device according to claim 1, wherein the auditory signal transferred by the at least one auditory relay unit includes the one or more predetermined acoustic whole sounds.

3. The device according to claim 1, wherein the housing of each of the one or more vibrational units is in the shape of either a generally rectangular box or a generally wedge-shaped box configured to be disposed underneath a portion of a body of the individual.

4. The device according to claim 1, wherein the device is configured to deliver the one or more acoustic whole sounds to an individual's body aurally, conductively, acoustically, piezoelectrically, or a combination thereof.

5. The device according to claim 1, wherein the housing of each of the one or more vibrational units is in the shape of a generally U-shaped elongated member configured to be worn around a neck of the individual.

6. The device according to claim 1, wherein the at least one auditory relay unit is electrically coupled to a side of the housing of the one or more vibrational units by means of an electrical cord.

7. The device according to claim 1, wherein the housing of each of the one or more vibrational units is in the shape of a notebook-sized rectangular box configured to be placed underneath one or more limbs of the body of the individual.

8. A method for relaxing and promoting healing of biological tissue, the method being comprised of the steps of:

positioning a device adjacent to an individual's body, the device consisting essentially of:

an inputting means configured to generate a digital signal based upon one or more predetermined acoustic whole sounds introduced to the inputting means, the one or more predetermined acoustic whole sounds comprising proportional harmonic overtone frequencies, and the one or more predetermined acoustic whole sounds being configured to engage and direct tissues and cells of human beings through whole sound harmonic frequencies;

one or more vibrational units connected to the inputting means, the one or more vibrational units comprising a housing, the housing being in the shape of either a generally rectangular box or a generally wedge-shaped box configured to be disposed underneath a portion of a body of the individual, and the one or more vibrational units having:

a user interface;

a processing means for generating frequency pulse waves based upon the digital signal relayed by the connected inputting means; and one or more transducers disposed inside the housing, the one or more transducers configured to vibrate the one or more vibrational units using the one or more predetermined acoustic whole sounds effective to transfer the one or more predetermined acoustic whole sounds into one or more of bones, tissues or peripheral nerves of the individual's body; and at least one auditory relay unit connected to the inputting means, the at least one auditory relay unit having speakers for transferring an auditory signal associated with the digital signal of the inputting means;

positioning the individual in a seated position on a chair with a base;

positioning the at least one auditory relay unit near or on the individual's body; and positioning the one or more vibrational units underneath the feet of the individual proximate to the base of the chair; and orchestrating synchronized vibrations and auditory signals for a predetermined period of time.

9. The method according to claim 8, wherein the auditory signal transferred by the at least one auditory relay unit includes the one or more predetermined acoustic whole sounds.

10. The method according to claim 8, wherein the one or more predetermined acoustic whole sounds are delivered to the individual's body aurally, conductively, acoustically, piezoelectrically, or a combination thereof.

11. The method according to claim 8, wherein the individual performs one or more physical activities in conjunction with the step of positioning the device adjacent to the individual's body.

12. The method according to claim 8, wherein the at least one auditory relay unit is electrically coupled to a side of the housing of the one or more vibrational units by means of an electrical cord.

13. A system for relaxing and promoting healing of biological tissue, the system comprising:

one or more computers for analyzing and/or monitoring physiological status of an individual;

a device connected to the one or more computers, the device comprising:

an inputting means configured to generate a digital signal based upon one or more predetermined acoustic whole sounds introduced to the inputting means, the one or more predetermined acoustic whole sounds comprising proportional harmonic overtone frequencies, and the one or more predetermined acoustic whole sounds being configured to engage and direct tissues and cells of human beings through whole sound harmonic frequencies;

one or more vibrational units connected to the inputting means, the one or more vibrational units comprising a housing, the housing being in the shape of a generally U-shaped elongated member configured to be worn around a neck of the individual, and the one or more vibrational units having:

a user interface;

a processing means for generating frequency pulse waves based upon the digital signal relayed by the connected inputting means; and one or more transducers disposed inside the housing, the one or more transducers configured to vibrate the one or more vibrational units using the one or more predetermined acoustic whole sounds effective to transfer the one or more predetermined acoustic whole sounds into one or more of bones, tissues or peripheral nerves of the individual's body; and at least one auditory relay unit connected to the inputting means, the at least one auditory relay unit having speakers for transferring an auditory signal associated with the digital signal of the inputting means;

wherein the one or more vibrational units and the at least one auditory relay unit are configured to be placed in contact with the individual for a predetermined period of time.

14. The system according to claim 13, wherein the auditory signal transferred by the at least one auditory relay unit includes the one or more predetermined acoustic whole sounds.

15. The system according to claim 13, wherein the system is configured to deliver the predetermined acoustic whole sounds to an individual's body aurally, conductively, acoustically, piezoelectrically, or a combination thereof.

16. The system according to claim 13, wherein the at least one auditory relay unit is electrically coupled to a side of the housing of the one or more vibrational units by means of an electrical cord.

17. A method for relaxing and promoting healing of biological tissue, the method being comprised of the steps of:

positioning a device adjacent to an individual's body, the device consisting essentially of:

an inputting means configured to generate a digital signal based upon one or more predetermined acoustic whole sounds introduced to the inputting means, the one or more predetermined acoustic whole sounds comprising proportional harmonic overtone frequencies, and the one or more predetermined acoustic whole sounds being configured to engage and direct tissues and cells of human beings through whole sound harmonic frequencies;

one or more vibrational units connected to the inputting means, the one or more vibrational units comprising a housing, the housing being in the shape of a generally U-shaped elongated member configured to be worn around a neck of the individual, and the one or more vibrational units having:

a user interface;

a processing means for generating frequency pulse waves based upon the digital signal relayed by the connected inputting means; and one or more transducers disposed inside the housing, the one or more transducers configured to vibrate the one or more vibrational units using the one or more predetermined acoustic whole sounds effective to transfer the one or more predetermined acoustic whole sounds into one or more of bones, tissues or peripheral nerves of the individual's body; and at least one auditory relay unit connected to the inputting means, the at least one auditory relay unit having speakers for transferring an auditory signal associated with the digital signal of the inputting means;

positioning the at least one auditory relay unit near or on the individual's body;

positioning the one or more vibrational units around a portion of the neck of the individual; and orchestrating synchronized vibrations and auditory signals for a predetermined period of time.

* * * * *